US007275757B2

(12) United States Patent
Hoesl et al.

(10) Patent No.: US 7,275,757 B2
(45) Date of Patent: Oct. 2, 2007

(54) ARRANGEMENT FOR LONGITUDINAL ADJUSTMENT OF TWO BINDING JAWS OF A SKI BINDING

(75) Inventors: Erwin Hoesl, Hundsheim (AT); Christoph Wurm, Mannswoerth (AT); Gernot Jahnel, Katzelsdorf (AT); Hubert Wuerthner, Hainburg (AT); Franz Ollinger, Hundsheim (AT); Alois Himmetsberger, Vienna (AT)

(73) Assignee: Tyrolia Technology GmbH, Schwechat (AT)

( * ) Notice: Subject to any disclaimer, the term of this patent is extended or adjusted under 35 U.S.C. 154(b) by 80 days.

(21) Appl. No.: 11/079,892

(22) Filed: Mar. 14, 2005

(65) Prior Publication Data

US 2005/0212262 A1 Sep. 29, 2005

(30) Foreign Application Priority Data

Mar. 15, 2004 (EP) ..... 04006055

(51) Int. Cl.
*A63C 9/00* (2006.01)

(52) U.S. Cl. ..... 280/617; 280/633

(58) Field of Classification Search ..... 280/616, 280/617, 14.23, 14.24, 11.26, 633, 607
See application file for complete search history.

(56) References Cited

U.S. PATENT DOCUMENTS 3,137,014 A * 6/1964 Meucci ..... 441/70
4,310,170 A * 1/1982 Linecker ..... 280/636
4,403,785 A * 9/1983 Hottel ..... 280/14.23
4,955,633 A * 9/1990 Stritzl et al. ..... 280/633
4,997,199 A * 3/1991 Horn ..... 280/618
5,211,417 A * 5/1993 Klaus et al. ..... 280/617
5,261,688 A 11/1993 Rohrmoser
5,344,178 A 9/1994 Rohrmoser
5,344,179 A * 9/1994 Fritschi et al. ..... 280/618
5,498,017 A * 3/1996 Rohrmoser ..... 280/633
5,782,476 A * 7/1998 Fardie ..... 280/14.24
6,092,829 A * 7/2000 Mercier ..... 280/617

(Continued)

FOREIGN PATENT DOCUMENTS

DE 3150098 A1 7/1982

(Continued)

OTHER PUBLICATIONS

European International Search Report dated Aug. 12, 2004 (3 pages).

*Primary Examiner*—Christopher Bottorff
(74) *Attorney, Agent, or Firm*—Flynn, Thiel, Boutell & Tanis, P.C.

(57) ABSTRACT

An arrangement for longitudinal adjustment of two binding jaws of a ski binding has base parts which are guided for longitudinal displacement on guide elements attached to the ski. Strip-shaped or similar connecting elements extend parallel to one another in the direction of the other binding jaw. A fixing device interacts with the connecting elements. Raised portions of the connecting elements can be brought into and out of engagement with raised portions of the fixing device upon actuation of the fixing device by a relative movement parallel to the upper side of the ski.

If the arrangement is blocked with ice or snow, functioning is ensured because the raised portions which can be brought into and out of engagement with one another are oriented essentially vertically in relation to the upper side of the ski.

11 Claims, 4 Drawing Sheets

U.S. PATENT DOCUMENTS

| | | | | |
|---|---|---|---|---|
| 6,189,911 | B1 * | 2/2001 | Caron et al. | 280/607 |
| 6,234,494 | B1 * | 5/2001 | Gien | 280/14.24 |
| 6,315,318 | B1 * | 11/2001 | Caron et al. | 280/617 |
| 6,520,531 | B1 * | 2/2003 | Gien | 280/618 |
| 6,779,810 | B1 * | 8/2004 | Mangold | 280/634 |
| 6,824,158 | B1 * | 11/2004 | Keller et al. | 280/618 |
| 6,840,531 | B2 * | 1/2005 | Gorza et al. | 280/617 |
| 6,848,704 | B2 * | 2/2005 | Lucas | 280/613 |
| 6,910,706 | B2 * | 6/2005 | Holzer et al. | 280/618 |
| 6,935,651 | B2 * | 8/2005 | Krumbeck et al. | 280/616 |
| 7,036,842 | B2 * | 5/2006 | Krumbeck et al. | 280/618 |
| 2003/0209881 | A1 | 11/2003 | Krumbeck et al. | |

FOREIGN PATENT DOCUMENTS

| | | | |
|---|---|---|---|
| DE | 4135899 | A1 | 6/1992 |
| EP | 1360977 | A1 | 11/2003 |

* cited by examiner

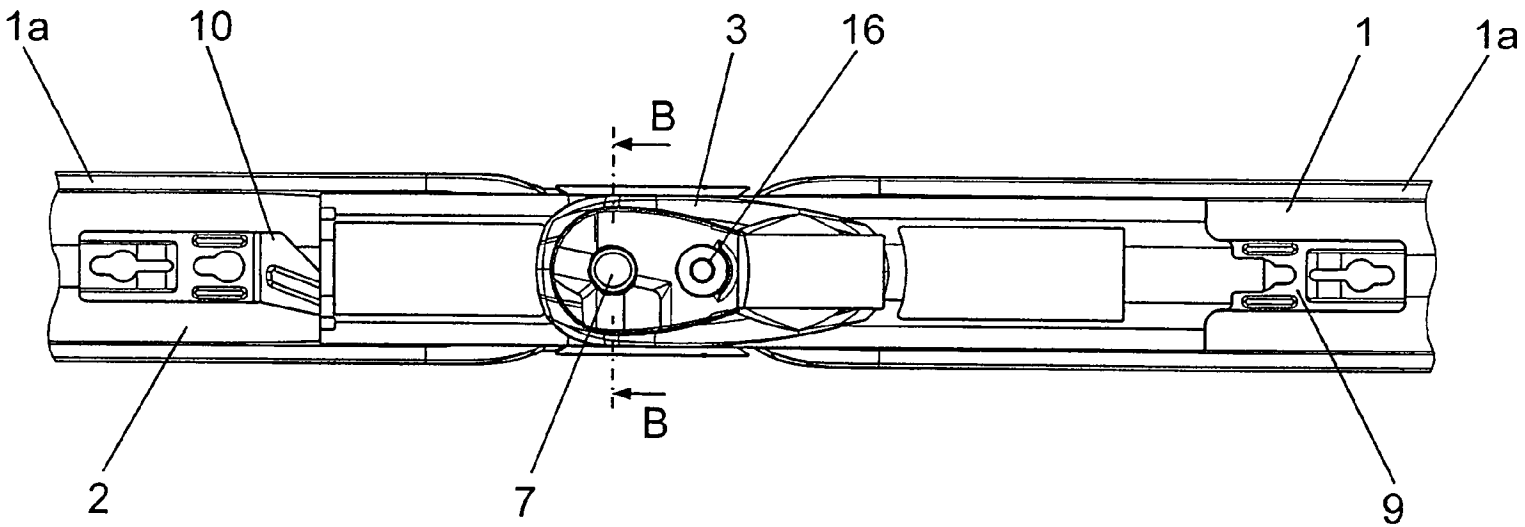
Fig. 2
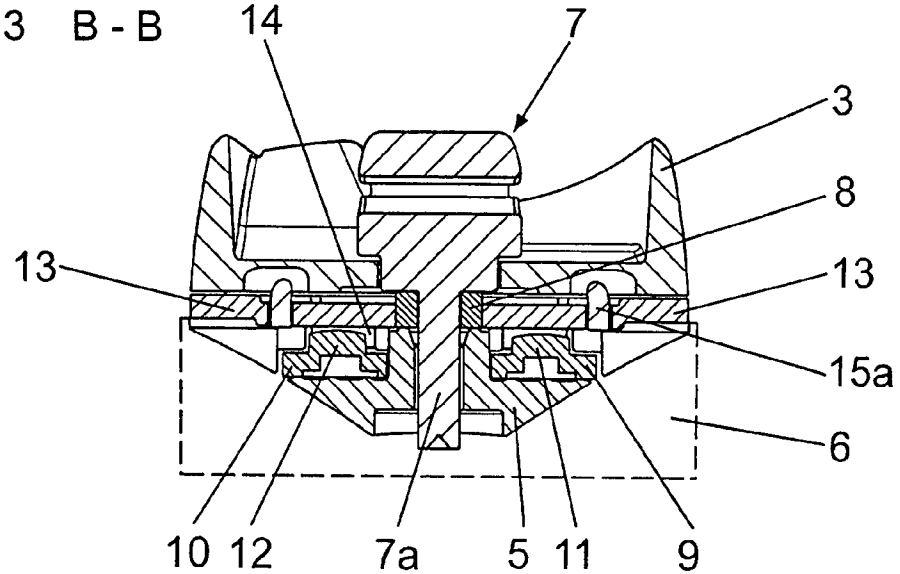
Fig. 3 B - B

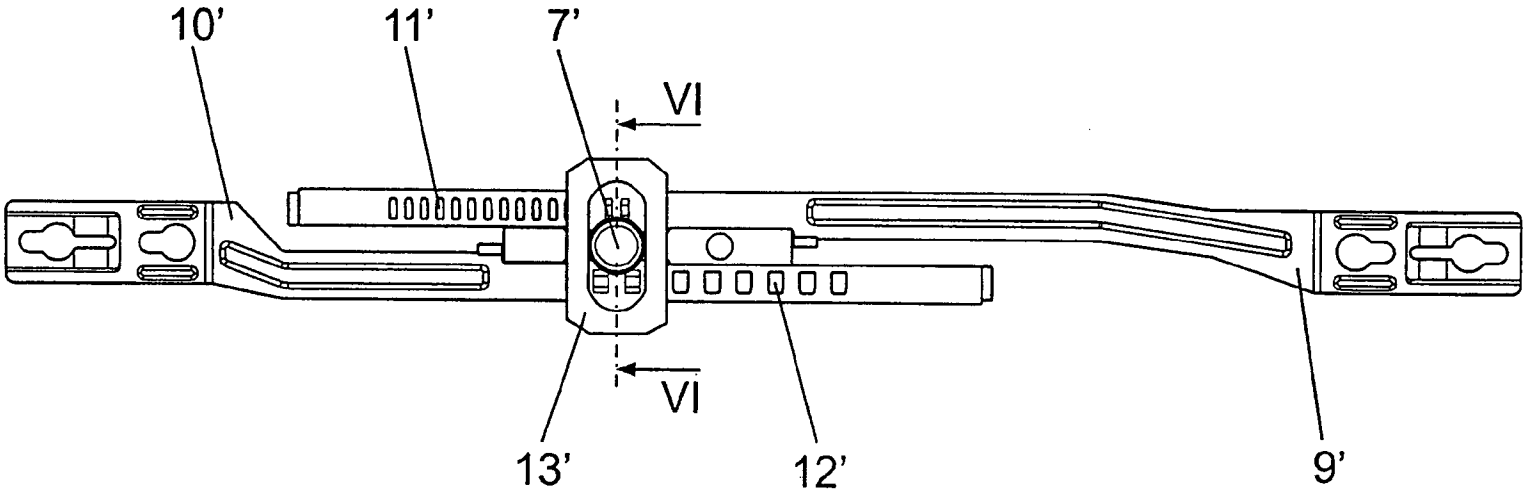
Fig. 5
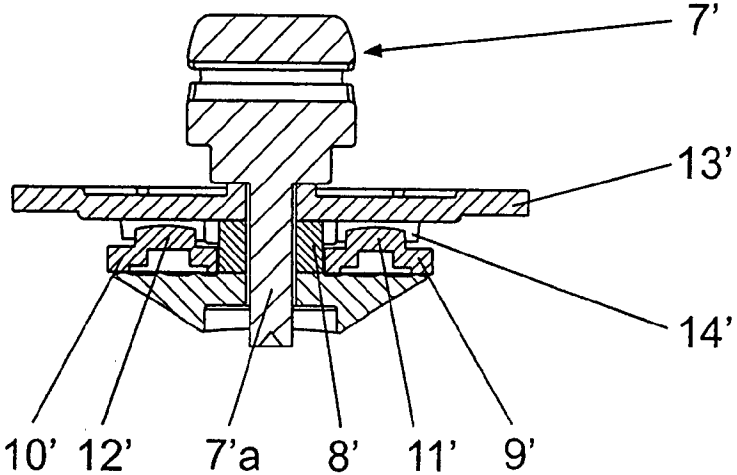
Fig. 6 VI - VI

ARRANGEMENT FOR LONGITUDINAL ADJUSTMENT OF TWO BINDING JAWS OF A SKI BINDING

This application is based on European patent application 04006055.0, filed Mar. 15, 2004, which is incorporated herein in its entirety.

FIELD OF THE INVENTION

The invention relates to an arrangement for longitudinal adjustment of two binding jaws of a ski binding, which has base parts which are guided longitudinally displaceably on guide elements attached to the ski and to which in each case a connecting element of strip-shaped or similar design is connected, which connecting elements extend parallel to one another in the direction of the other binding jaw, a fixing device interacting with the two connecting elements being provided, on the actuation of which raised portions provided on the connecting elements can be brought into and out of engagement with raised portions provided on the fixing device by a relative movement parallel to the upper side of the ski.

BACKGROUND OF THE INVENTION

Such an arrangement is known from EP-A-1 360 977. The two connecting strips are toothed on their longitudinal edges facing away from one another, an eccentric being arranged between the connecting strips, which interacts with the facing edges of the connecting strips and in a rotary position spreads these apart from one another and in this way brings the toothings on the connecting strips into engagement with counter-toothings of the fixing device. In this connection, a positive coupling of the connecting strips via a gearwheel can be provided, so that the ski binding parts can be adjusted only synchronously.

Another design of an adjusting device with synchronous adjustment via a gearwheel is known from DE-A-41 35 899. The gearwheel, which is mounted rotatably in the central region between toe-piece and heel-holder and in which toothings of the two connecting strips engage, can be locked by means of a securing device and consequently prevented from rotating. In another design, the connecting strips interact with locking elements which are guided adjustably transversely to the longitudinal axis of the binding and can be brought into and out of engagement with the toothings of the connecting strips and fixed in the desired positions. In the engagement position, the locking elements are retained by compression springs.

SUMMARY OF THE INVENTION

The object of the invention is to design an arrangement of the type referred to in the introduction in such a way that the relative position of the two binding jaws can be adjusted in a simple and problem-free way. It is to be possible for the components of the adjusting device to be accommodated in as space-saving a manner as possible, and they are to be robust and functionally reliable, even in case of blocking with snow and/or ice.

According to the invention, the object set is achieved by virtue of the fact that the raised portions which can be brought into and out of engagement with one another are oriented at least essentially vertically in relation to the upper side of the ski.

A robust and functionally reliable design is thus ensured. The vertical arrangement of the raised portions which can be brought into and out of engagement has above all the advantage that accumulated snow is pushed away simply out of the locking region by the relative movement in a plane parallel to the upper side of the ski. This is not the case in a design as known from EP-A-1 360 977. The toothings, which extend in a plane parallel to the upper side of the ski and can be brought into and out of engagement with one another, cannot, during the relative movement necessary for longitudinal displacement, push away snow which has penetrated, and adjusting the binding in the open, as is often common practice when hiring, can therefore be problematic. The invention also has the advantage that the connecting strips and the fixing device of the arrangement according to the invention can be made particularly robust and arranged in a space-saving way.

In a preferred embodiment of the invention, the connecting strips are retained in the transverse direction of the ski and the fixing device has sliders which are displaceable in the transverse direction of the ski. In this way, the arrangement according to the invention can be constructed in a particularly compact and space-saving way.

In another variant, the two connecting strips can be spread apart from one another in the transverse direction of the ski and the fixing device has a locking element which is stationary in relation to it.

It is advantageous if the engagement position can be freed counter to spring force. Automatic bringing about of the engagement of the fixing device with the connecting elements, after longitudinal adjustment has been carried out, is thus also supported.

In an especially simple way, the freeing of the engagement, in order for it to be possible to perform a relative adjustment of the spacing of the two ski binding parts, can be effected by means of a rotatably arranged eccentric. According to embodiment, the eccentric is then active between the two sliders or between the connecting elements.

In an advantageous and simple way, the spring action is possible by means of a torsion spring, the legs of which grip the sliders or the connecting elements.

The invention also relates to a ski binding, which is provided with an arrangement according to the invention, and to a ski, which is provided with such a ski binding.

BRIEF DESCRIPTION OF THE DRAWINGS

Further features, advantages and details of the invention are described in greater detail with reference to a diagrammatic drawing, which represents two illustrative embodiments and in which

FIG. 2 shows a top view of the arrangement without actuating lever;

FIG. 3 shows a section along the line III-III in FIG. 2;

FIG. 5 shows a top view of important components of a further variant of the invention, and FIG. 6 shows a section along the line VI-VI in FIG. 5.

DETAILED DESCRIPTION OF THE INVENTION

Figure 1:
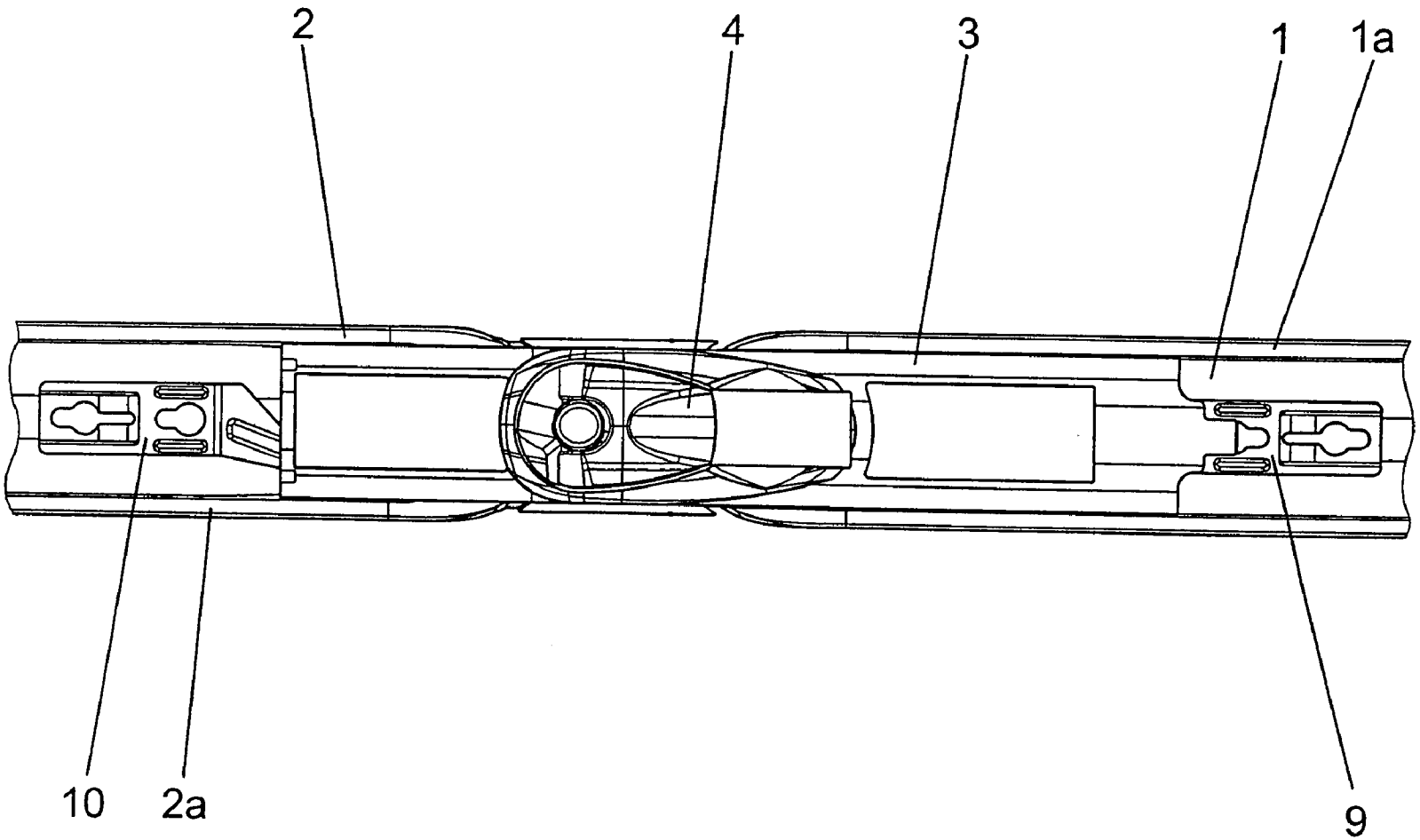
FIG. 1 shows a top view of a variant of an arrangement designed according to the invention.

The arrangement according to the invention is intended for adjusting and fixing the relative spacing of a ski binding (not illustrated) having two binding jaws—a toe-piece and a heel-holder. The toe-piece and the heel holder of the ski binding can be of any conventional design. In FIGS. 1 and 2, a support plate 1 for a heel-holder and a support plate 2 for a toe-piece are indicated. On the longitudinal sides of the support plates 1, 2, guide strips 1*a*, 2*a* bent in the direction of the upper side of the ski approximately in a C-shape can be provided in a known way, so that, in a known way, the support plates 1, 2 can be pushed onto guide rails attached to the ski and can be guided slidably movably on these. The guide rails (not illustrated) can for each support plate 1, 2 be components made of one or more parts, so that two guide rails extending in the longitudinal direction of the ski can also be provided for each support plate 1, 2. The guide rails can be fastened on the upper side of the ski by means of screws or can already have been integrated into the ski structure or anchored in the interior of the ski during manufacture of the ski. In this connection, the guide rails may also be arranged in recesses or depressions of the ski.

The important components of the adjusting device, which will now be described in greater detail below, are covered by a cover 3 shown in FIG. 1 and FIG. 2. For locking and unlocking the longitudinal adjustment device, as in particular FIG. 3 shows, a rotary lever 7 is provided, which has a central pin 7*a*, which forms an axis of rotation running perpendicularly to the upper side of the ski and is arranged rotatably in a housing 5. The housing 5 is located in a recess of a plate 6 arranged on the upper side of the ski and connected to the ski. FIG. 1 shows an actuating lever 4, which can be lifted up transversely to the longitudinal direction of the ski and is provided for rotating the rotary lever 7. The actuating lever 4 covers a screw 16, which can be fixed in the plate 6 in a number of positions in the longitudinal direction of the ski, so that the entire arrangement together with the ski binding parts can be secured in relation to the ski and, if required, can be moved into another of the designated positions. An eccentric 8, which is an essentially oval or elongate part, is connected firmly to the pin 7*a* of the rotary lever 7. As in particular FIG. 4 shows, the eccentric 8 extends approximately in the longitudinal direction of the ski in the locked position of the adjusting device.

Figure 4:
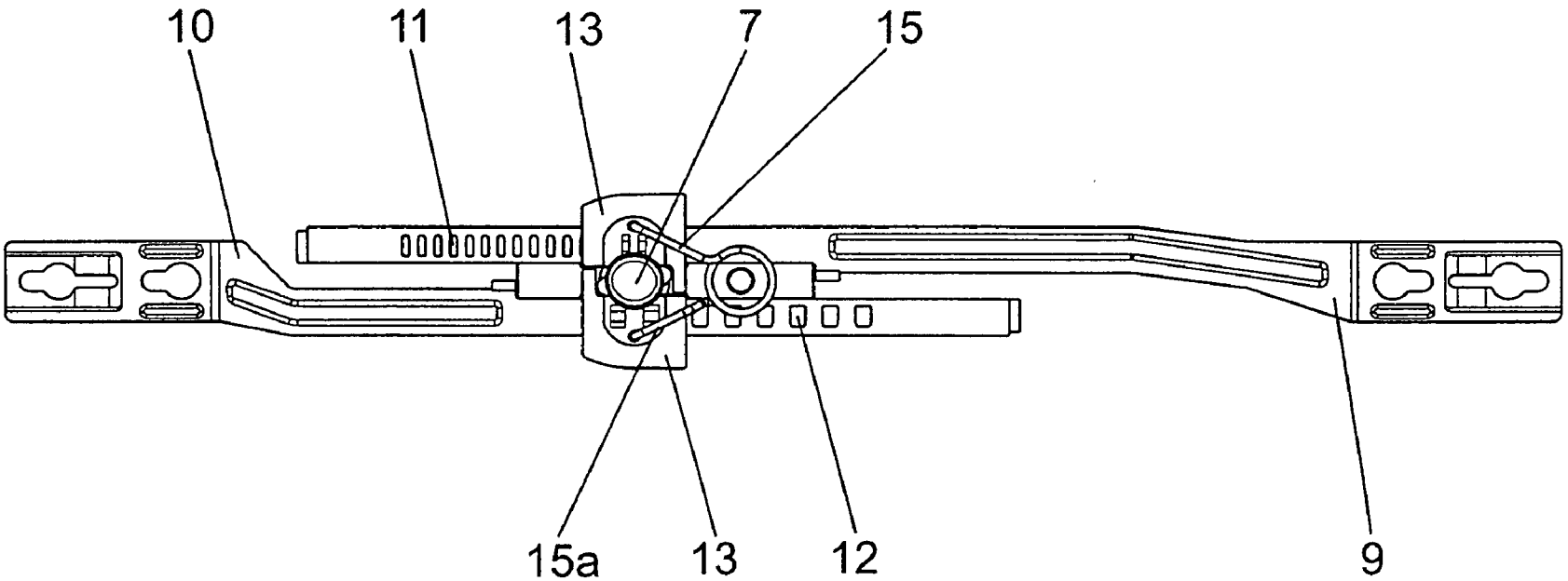
FIG. 4 shows a top view of important components of the adjusting and fixing device in the locked position.

As in particular FIGS. 3 and 4 show, the components of the arrangement include two strip-shaped connecting elements 9, 10, one connecting element 9 being connected to the support plate 1 of the heel-holder and the other connecting element 10 being connected to the support plate 2 of the toe-piece. The connection is effected by riveting, for example. The two connecting elements 9, 10 extend next to and parallel to one another over a major part of their extent. The two connecting elements 9, 10 are movable and displaceable relative to one another in the longitudinal direction of the ski by virtue of their connection to the support plates 1, 2 but are retained transversely to the longitudinal direction of the ski between the housing 5 and the cover 3. Each connecting element 9, 10 is provided on its upper side with a series of raised portions 11, 12 running in the longitudinal direction of the ski, the relative spacing of which is the same on each connecting element 9, 10. The number of raised portions 11 on the connecting element 9, which is connected to the support plate 1 for the heel-holder, is greater, and their extent in the longitudinal direction of the ski and their relative spacing are smaller than in the case of those raised portions 12 provided on the connecting element 10, which is connected to the support plate 1 for the toe-piece. When the strips 9, 10 are made of sheet metal, the raised portions 11, 12 can be produced by stamping.

Two sliders 13 are arranged and can be moved in the transverse direction of the ski in a recess formed on the lower side of the cover 3. The eccentric 8 is located between the two sliders 13, so that the sliders 13 can be actuated together by it. Each slider 13 is provided on its lower side facing the upper side of the ski with a pair of projections 14, the relative arrangement of which is such that the projections 14 can fit into or engage in two interspaces between the raised portions 11, 12. A receiving groove (not illustrated) for the round central part of a torsion spring 15 is designed on the lower side or the inner side of the cover 3. One leg 15*a* of the torsion spring 15 is with its bent end region hooked on one slider 13, and the second leg 15*a* of the torsion spring 15 is hooked on the second slider 13. The torsion spring 15 pulls the two sliders 13 toward one another and therefore also resists relative displacement of the two sliders 13.

The embodiment of the arrangement according to the invention shown in FIGS. 1 to 4 functions as follows.

In the locked position shown in these figures, the eccentric 8 is located in its unactuated position, and the torsion spring 15 retains the two sliders 13 in their locked position, that is to say the projections 14 are located in interspaces between the raised portions 11, 12 of the connecting elements 9, 10.

If the relative spacing of the two ski binding parts is now to be changed, the actuating lever 4 is tilted up and rotated. As a result, the rotary lever 7 together with the eccentric 8 is rotated, so that the eccentric 8 pushes or moves the two sliders 13 apart from one another. The projections 14 therefore come out of engagement with the interspaces between the raised portions 11, 12. The ski binding parts can now be displaced on the guide rails attached to the ski. Once the desired spacing between the two ski binding parts has been set, the arrangement is brought back into the locked position. To this end, the rotary lever 7 is rotated back by means of the actuating lever 4, as a result of which the eccentric 8 returns to its starting position. The two legs 15 of the torsion spring 15 return the two sliders 13 to their starting position, and the projections 14 engage between raised portions 11, 12 of the connecting elements 9, 10.

In the embodiment shown in FIGS. 5 and 6, the two connecting elements 9', 10' are fastened to the support plates (not shown here) for the ski binding parts in such a way that they can be moved slightly away or spread slightly apart from one another in that region in which they extend parallel to one another. In this embodiment as well, the two connecting elements 9', 10' extend in a plane and parallel to the upper side of the ski (not shown), and they are each provided with a series of raised portions 11', 12' on their upper sides. The connecting elements 9', 10' are therefore embodied similarly to those according to the first embodiment. Instead of two sliders, the fixing device has a locking element 13', which is stationary in relation to the connecting elements 9', 10', can be inserted on the lower side of the cover (not shown here) and is provided on its lower side facing the upper side of the ski with two pairs of projections 14'. The locking element 13' can also be a component of the cover or of the covering housing. In any case, the arrangement in this embodiment is also such that the projections 14' can fit into and engage in two interspaces between the raised portions 11', 12'. In this embodiment, the two connecting elements 9', 10' are acted on in a way not illustrated by the two legs of a torsion spring or the like, which acts on the connecting elements 9', 10' in the direction toward one another. This spring can, for example, grip around the outer edges of the connecting elements 9', 10' with its two bent leg ends. In this embodiment, the eccentric 8' is arranged below the locking element 13' between the connecting elements 9', 10' and connected firmly to the pin 7'*a* of the rotary lever 7.

The embodiment shown in FIGS. 5 and 6 functions as follows.

In the locked position shown in FIGS. 5 and 6, the eccentric 8' is located in its unactuated position, and the projections 14' of the locking element 13' are located in interspaces between the raised portions 11', 12' of the connecting elements 9', 10'.

To change the relative spacing of the two ski binding parts, an actuating lever, which is not shown here but can be designed and arranged similarly to the first embodiment, is tilted up and rotated in this embodiment as well, as a result of which the rotary lever 7' together with the eccentric 8' is rotated, so that the eccentric 8' spreads the two connecting elements 9', 10' apart from one another, as a result of which the projections 14' come out of engagement with the connecting elements 9', 10'. The two ski binding parts can now be brought to the desired relative spacing by displacement in their guide rails attached to the ski. The spacing is fixed by the rotary lever 7' being rotated back, as a result of which the eccentric 8' returns to its starting position. At the same time, the spring (not shown) returns the two connecting elements 9', 10' to their parallel relative position, as a result of which the projections 14' pass between raised portions 11', 12' of the connecting elements 9, 10'.

The invention is not limited to the illustrative embodiments represented. Thus, the torsion spring can be replaced by one or more other spring(s). The connecting elements can also extend above the two sliders, in which case the raised portions would be designed on the lower sides of the connecting elements and the projections on the upper sides of the sliders.

What is claimed is:

1. Arrangement for longitudinal adjustment of two binding jaws of a ski binding, which has base parts which are guided longitudinally displaceably on guide elements attached to the ski and to which in each case a connecting element of strip-shaped or similar design is connected, which connecting elements extend parallel to one another in the direction of the other binding jaw, a fixing device interacting with the two connecting elements being provided, on the actuation of which raised portions provided on the connecting elements can be brought into and out of engagement with raised portions provided on the fixing device by a relative movement parallel to the upper side of the ski, wherein the connecting elements are arranged between the fixing device and the ski, and the raised portions engage each other in a plane defined between the connecting elements and the fixing device and parallel to the upper side of the ski.

2. Arrangement according to claim 1, wherein the connecting elements are retained in the transverse direction of the ski and the fixing device has two sliders which are displaceable in the transverse direction of the ski.

3. Arrangement according to claim 1, wherein the two connecting elements can be spread apart from one another in the transverse direction of the ski and the fixing device has a locking element which is stationary in relation to the ski.

4. Arrangement according to claim 1, wherein the engagement can be freed by rotation of an eccentric.

5. Arrangement according to claim 4, wherein the eccentric is arranged and active between two sliders forming a portion of the fixing device and displaceable in the transverse direction of the ski.

6. Arrangement according to claim 4, wherein the eccentric is arranged and active between the connecting elements.

7. Arrangement according to claim 2 further comprising a torsion spring, having legs which grip the slider or the connecting elements.

8. Ski binding, which has an arrangement according to claim 1.

9. Ski with a ski binding according to claim 8.

10. Arrangement according to claim 1, wherein the raised portions extend toward each other from the connecting elements and the fixing device in a direction perpendicular to the surface of the ski.

11. Arrangement according to claim 1, wherein the raised portions engage each other in a direction transverse to the plane defined between the connecting elements and the fixing device, whereby snow or other foreign matter compacted between the raised portions is evacuated from between the raised portions as the raised portions are brought into and out of engagement.

* * * * *